US005393046A

United States Patent [19]

Garbe

[11] Patent Number: 5,393,046

[45] Date of Patent: Feb. 28, 1995

[54] SHEET-ALIGNING DEVICE

[75] Inventor: Siegfried Garbe, Stuttgart, Germany

[73] Assignee: Eastman Kodak Company, Rochester, N.Y.

[21] Appl. No.: 220,343

[22] Filed: Mar. 30, 1994

[30] Foreign Application Priority Data

Apr. 29, 1993 [DE] Germany ..... 4314075

[51] Int. Cl.[6] ..... B65H 31/26

[52] U.S. Cl. ..... 271/220; 271/184; 271/236; 271/251

[58] Field of Search ..... 271/236, 250, 253, 254, 271/220, 184, 185

[56] References Cited

U.S. PATENT DOCUMENTS

| | | | |
|---|---|---|---|
| 2,910,293 | 10/1959 | Kelchner | 271/236 |
| 3,970,299 | 7/1976 | Berger et al. | 271/236 |
| 4,257,587 | 3/1981 | Smith | 271/236 |
| 4,379,549 | 4/1983 | Miluma | 271/236 |
| 4,483,530 | 11/1984 | Spencer et al. | 271/250 |
| 5,284,338 | 2/1994 | Allmendinger et al. | 271/220 |
| 5,338,022 | 4/1994 | Funk et al. | 271/220 |

*Primary Examiner*—H. Grant Skaggs
*Attorney, Agent, or Firm*—Lawrence P. Kessler

[57] ABSTRACT

A device (1) for aligning sheets against two sheet abutments (3 and 5) which are disposed perpendicularly relative to each other consists of a rotatably mounted sleeve (6) in which a rod member (16) is guided. Rod member (16) is held in the sleeve by spring means (18). At least one aligning element (8) is mounted on sleeve (6) for pivotal movement about a pin (10), the aligning element being provided with a friction element (14) at one end. Spring means (24) connecting arm (12) of the aligning element with the lower end (22) of rod member (16) cause the friction element (14) to rest with a predetermined pressure force on the surface (4) of the uppermost sheet of paper.

7 Claims, 3 Drawing Sheets

SHEET-ALIGNING DEVICE

BACKGROUND OF THE INVENTION

1. Field of the Invention

The invention relates to a device for aligning sheets of a sheet stack against two sheet abutments which are disposed perpendicularly to each other, said device comprising at least one aligning element which is arranged about an axis inclined with respect to the surface of the sheet stack and includes a friction element.

2. Description of the Prior Art

A device for aligning sheet-type articles is disclosed in U.S. Pat. No. 3,970,299 (issued Jul. 20, 1976, in the names of Emil J. Berger, Jr. and John M. Mitchard). In that device, sheet-type articles are transported on a conveying means. To facilitate uniform alignment of the sheets, guide rails are secured to the transport means and arranged both vertically to, and parallely with the direction of transport. For aligning the sheets with respect to the guide rail extending in parallel with the transport direction, a rotating brush is used which exerts a force on the sheet-type articles in order to move them into engagement with the lateral guide rail. The constant contact of the brush used in the prior art device is disadvantageous since alignment in the two spatial directions cannot be carried out separately. Moreover, the known device serves for aligning individual sheets transported along a travel path rather than sheets arriving on a sheet stack.

Japanese Patent Application 59-120746 discloses a paper aligning device for a copier, in which the sheet is aligned with a guide provided laterally in the direction of transport of the sheet. At the beginning of the aligning operation, the aligning mechanism is arranged at an angle to the direction of transport and thus applies a motion component to the sheet in a direction transversely perpendicular to the direction of transport. As soon as the sheet has been aligned transversely perpendicular to the direction of transport, the aligning mechanism is urged into a position parallel with the direction of transport whereupon the sheet is completely aligned parallel to the transport direction. This aligning device is disadvantageous in that the continuously operating aligning mechanism obstructs free movement of successive sheets.

An International Patent Application WO 89/08599 describes a depositing mechanism for stacking sheet-type record carders in an exit tray of a printing device. Using such depositing mechanisms, record carriers are to be stacked in the exit tray such that the record carriers forming part of different printing orders are clearly identified in the deposited stack. Depending on the printing order, the record carriers are aligned against the side walls of the exit tray by rotary advancing elements. The advancing elements feature radially projecting flexible wings. The force component required for alignment is transmitted to the record carrier by frictional contact between the wings of the rotary advancing element and the record carder. The aforementioned disadvantages, e.g. the obstruction of successive sheets, are also encountered in this device. In addition, the simultaneous action of force components in two spatial directions can cause damage to the sheets.

SUMMARY OF THE INVENTION

It is the purpose of this invention to provide a device which permits, by means of a movable friction element, a plurality of sheets to be built up to form an aligned sheet stack such that two edges are obtained which are precisely aligned against lateral abutments. Moreover, sheets of different formats and/or different individual sheet weights are to be handled. Also, the normal-force component of the friction element acting on the sheet is to be independent of the stack height and the dynamic energy to be transmitted to the sheet is to be very low.

According to the invention, this purpose is attained in a device in which them is mounted for rotation about an axis, a sleeve in which a rod member is slidably guided and which is held by a resilient means. The aligning element is arranged on the sleeve for pivotal movement about a pin and resilient means is arranged between the lower end of the rod member and the aligning element such that the position and the mechanical tension of the aligning element can be changed in response to the movement of the rod member in the sleeve.

The device according to the invention is advantageous in that it need not be lifted by electromechanical means in order to clear the path for receiving successive sheets on the sheet stack. The sheet stack is not contacted by any aligning element between the individual alignment operations. Consequently a sheet arriving in the interval between two successive contacts can be moved without any hindrance onto the stack already present and kinetic energy can be reduced.

Moreover, every sheet has to be aligned in two spatial directions within the plane of the sheet stack. In contrast to known devices, this is brought about in that the curve of contact of a friction element with the sheet to be aligned operates such that the sheet is in part separately aligned in the two spatial directions. It is avoided in this manner that sheets which have already reached an alignment position continue to be influenced by a force component in that direction. Damage to the sheets to be aligned is thus substantially prevented.

Another advantage of the device according to the invention is that the normal force by which the friction element rests on the paper is constant up to a substantial stack height, for example of approximately 5 mm. Consequently, no expensive fine adjustments of the device are required for stack heights in that range. For handling greater stack heights, a coarse adjustment of the device suffices for obtaining a constant normal force.

According to a useful modification of the invention, the device includes two aligning elements offset by 180°. The rotation frequency of 1 hertz permits 120 sheets per minute to be processed. In contrast to prior-art devices, the transmission of dynamic forces is minimal owing to the low rotation frequency. A transmission of high dynamic energy to the system as encountered in prior known devices causes vibrations which are transmitted to the sheet stack and cause the sheets to be displaced within the stack, and a precise alignment is thus difficult.

The rotary mounting of the friction elements is particularly advantageous in that it not only prolongs the life of such elements but also ensures that there is a constant contact between sheet and friction element. Such constant contact surface is favorable to the requirement that the sheet should be subjected to a constant force.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

DESCRIPTION OF THE PREFERRED EMBODIMENT

Figure 1:
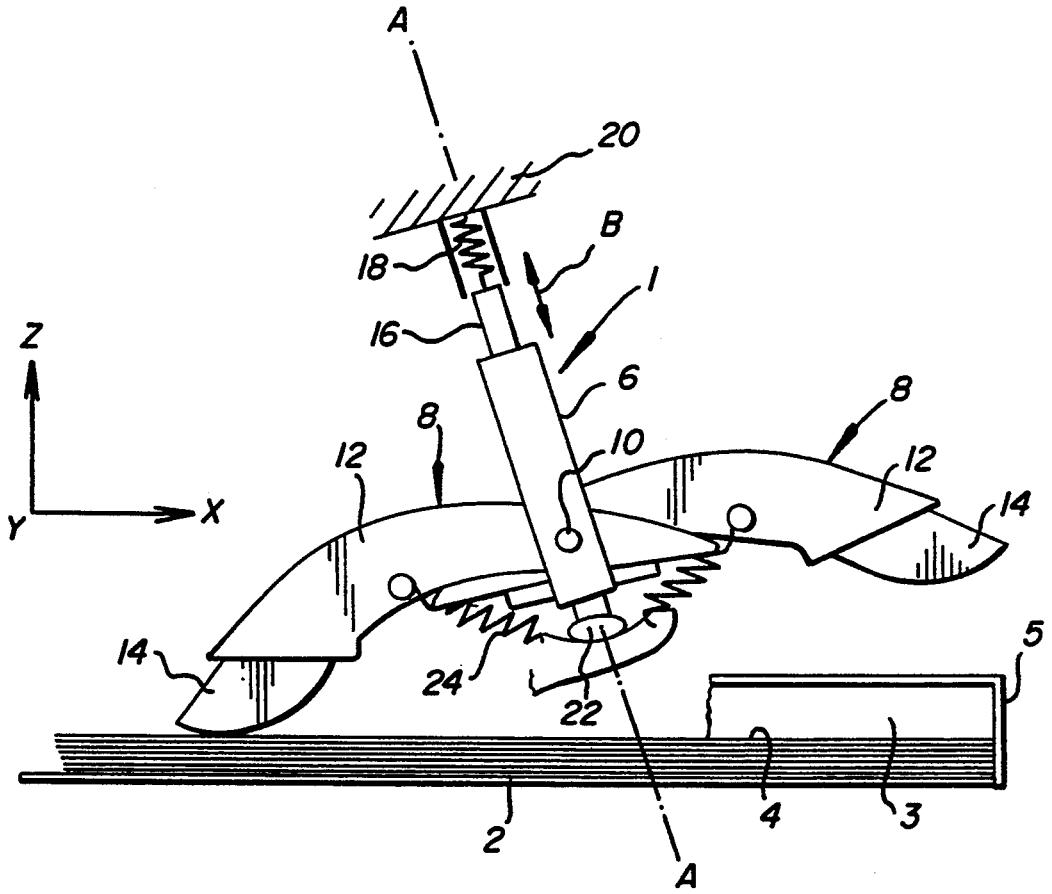
FIG. 1 is a schematic side elevational view of the sheet aligning device according to this invention.

FIG. 1 shows a device 1 for aligning sheets of a sheet stack 2 against two sheet abutments 3 and 5 which are disposed perpendicular to each other. The device is rotatable about an axis A—A which is inclined to the surface 4 of the sheet to be aligned. Two aligning elements 8 are pivotally mounted about a pin 10 on a sleeve 6. Each aligning element 8 consists of an arm 12 at the end of which a friction element 14 is arranged. Friction element 14 which is made of an elastomeric material is exchangeably attached to arm 12. A rod member 16, which is slidably guided within sleeve 6, is connected with a holder 20 by a resilient means 18, such as a Hookean spring for example. Thanks to resilient means 18, the rod member is axially movable in the direction of the double arrow B. Resilient means 24, which may also be a Hookean spring, is provided at the lower end 22 of rod member 16, such resilient means being each connected with the aligning elements 8. In this manner, movement of rod member 16 is transmitted to the aligning elements 8.

Figure 2:
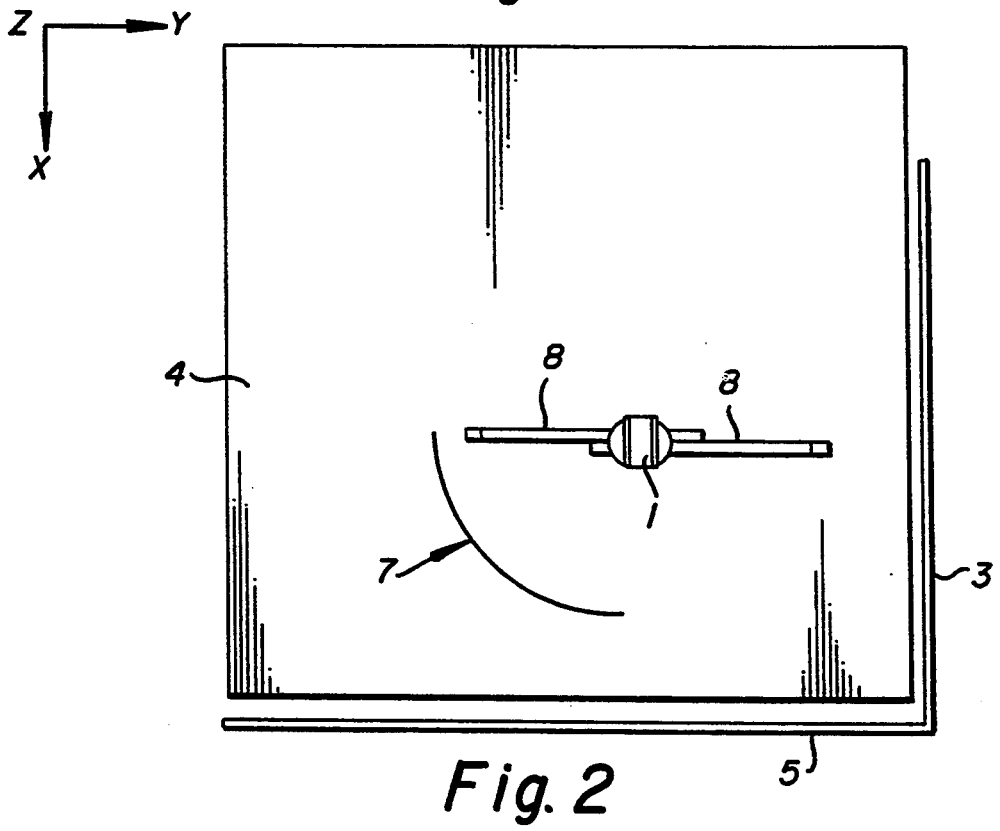
FIG. 2 is a top plan view of the sheet stacking means above which the sheet aligning device is arranged.

As can be inferred from FIG. 2, device 1 is arranged above the sheets to be aligned. Each of the aligning elements 8 describes a curve 7 on surface 4 of the sheet to be aligned such that the sheet is first aligned in the direction "x" against an abutment 5, and subsequently in the direction "y" against an abutment 3. The abutments 3 and 5 are arranged at right angles to each other.

Figure 3:
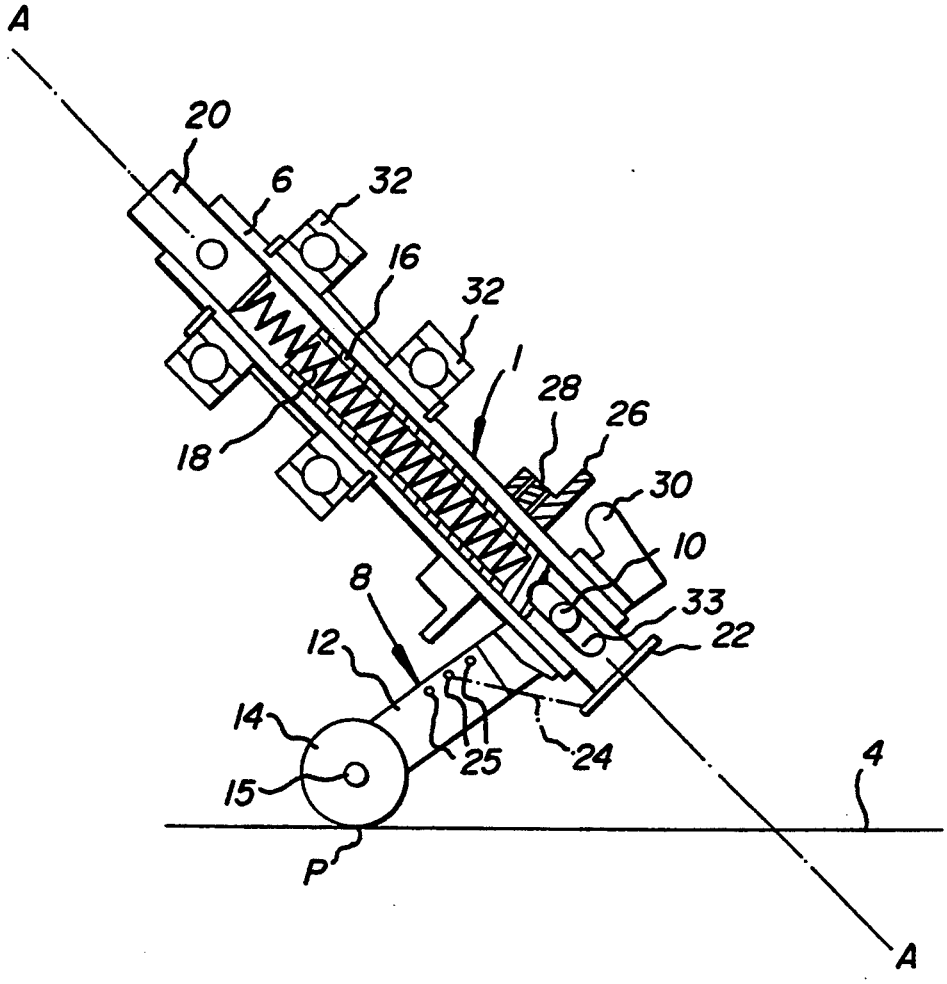
FIG. 3 is a side elevational view of the sheet aligning device of FIG. 1, partially in cross-section.

FIG. 3 shows a side elevational view partly in cross-section of an actual embodiment of device 1, with only one aligning element 8 being illustrated for reasons of clarity. Sleeve 6 is mounted in mounting means 32 for rotating about the axis A—A. Rod member 16, which is slidably guided in sleeve 6, is provided with an oblong hole 33 in the area of its lower end 22, such hole receiving the pin 10. The is aligning elements 8 take the form of lever arms and are pivotally mounted about pin 10. At the longer end of aligning arm 12, friction element 14 is provided which is rotatable about a journal 15 extending in parallel with the surface 4 of a sheet to be aligned. At point P, friction element 14 contacts the surface 4 of the sheet. On rotation of sleeve 6, the aligning elements 8 are moved such that point P describes the curve 7 illustrated in FIG. 2. The short side of aligning arm 12 features a nose 30 which rests against an abutment 26 on sleeve 6 for limiting movement of the aligning element 8 in the direction of the sheet to be aligned. By means of a screw 28 seated in abutment 26, the abutment can be arrested in selected positions on sleeve 6. As such, the device can effectively be used to align sheets in a stack of substantial height, for example up to 5 mm. Aligning arm 12 includes a number of bores 25 in which the resilient means 24 can be secured whose other ends are connected with the lower end 22 of rod member 16. The resilient means 24 exerts a force on arm 12 by which the arm is drawn in the direction of the sheet surface 4. By a suitable selection of the resilient means 24, the pressure force exerted by the friction element on the sheet surface 4 can be determined.

Figure 4:
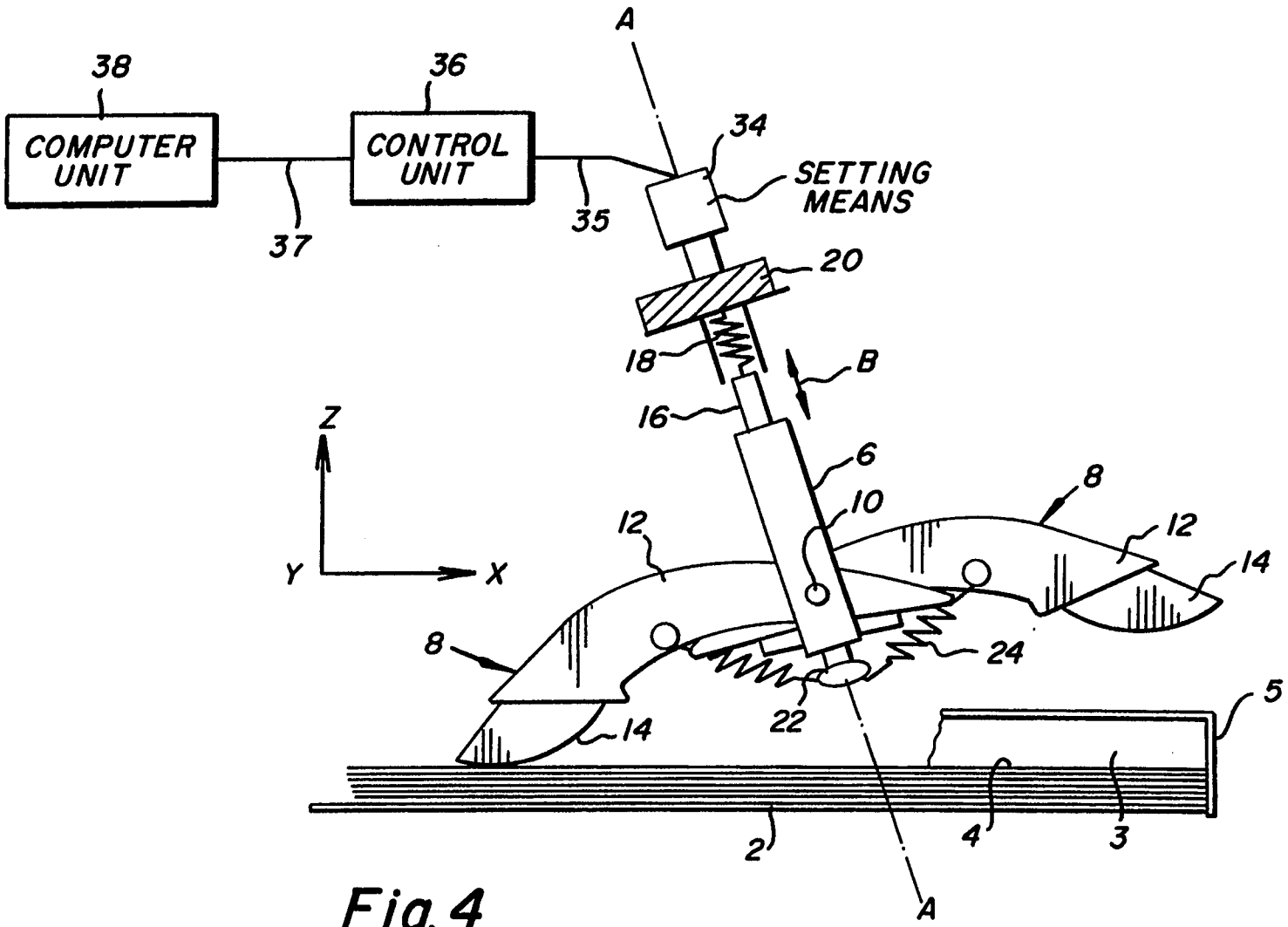
FIG. 4 is a schematic side elevational view of an alternate controllable embodiment of the sheet aligning device according to this invention.

An alternate embodiment of the device according to FIG. 1 is shown in FIG. 4. As explained above, the device 1 allows stack heights of up to 5 mm to be processed, with approximately the same normal force acting on each sheet to be aligned. In order that greater stack heights can be processed, an electromagnetic setting means 34 is provided on device 1 for moving the device stepwise along axis A—A in the direction of the arrow B. Via supply lead 35, a control unit 36 for the electromechanical setting means 34 supplies the setting means 34 with appropriate current pulses. A computer unit 38 collects information about the characteristics of the paper used and the number of sheets to be stacked. When the stack height is reached at which the requirement for a constant normal force is no longer fulfilled, a pulse is delivered to setting means 34 via lead 37, in response to which the electromechanical setting means 34 adjusts the device 1 accordingly.

The invention has been described in detail with particular reference to preferred embodiments thereof, but it will be understood that variations and modifications can be effected within the spirit and scope of the invention as set forth in the claims.

What is claimed is:

1. Device (1) for aligning sheets of a sheet stack (2) against two sheet abutments (3 and 5) which are disposed perpendicularly to each other, said device comprising:

at least one aligning element (8) rotatable about an axis (A—A) inclined with respect to the sheet surface, said aligning element (8) including a friction element (14);

a sleeve (6) mounted for rotation about said axis (A—A), a rod member (16) slidably guided in said sleeve, said rod being held by a resilient means (18);

said aligning element (8) being arranged on said sleeve (6) for pivotal movement about a pin (10); and a resilient means (24) arranged between the lower end (22) of said rod member (16) and said aligning element (8) such that the position and the mechanical tension of the aligning element (8) can be changed in response to the axial movement of said rod member (16) in said sleeve (6).

2. The sheet aligning device according to claim 1, wherein said resilient means (18, 24) are Hookean springs.

3. The sheet aligning device according to claim 1, wherein said aligning element (8) includes a nose (30) arranged at the end of said aligning element (8) opposite said friction element (14), and said sleeve (6) carrying an abutment (26), adjustable along the axis (A—A), against which said nose (30) may rest for limiting movement of said aligning element (8) in the direction of the uppermost sheet.

4. The sheet aligning device according to claim 3, further including a setting means (34) provided for moving said device (1), in response to the sheet-stack height, in the direction of the axis (A—A).

5. The sheet aligning device according to claim 4, wherein said friction element (14) is pivotally mounted on said aligning element (8) and comprises of an elastomeric material.

6. The sheet aligning device according to claim 5, wherein said friction element (14) is exchangeable.

7. The sheet aligning device according to claim 1, wherein the line of contact of said friction element (14) on the sheet surface represents an arcuate curve (7) which is such that the friction force acting on the sheet is first directed at one sheet abutment (5) and subsequently at the other sheet abutment (3).

* * * * *